US009565895B2

(12) United States Patent
Byrne

(10) Patent No.: US 9,565,895 B2
(45) **Date of Patent: *Feb. 14, 2017**

(54) FOOTWEAR WITH ELASTIC FOOTBED COVER AND SOFT FOAM FOOTBED

(71) Applicant: C & J CLARK INTERNATIONAL LIMITED, Street, Somerset (GB)

(72) Inventor: Richard Byrne, Marlborough, MA (US)

(73) Assignee: C & J CLARK INTERNATIONAL LIMITED, Street, Somerset (GB)

( * ) Notice: Subject to any disclaimer, the term of this patent is extended or adjusted under 35 U.S.C. 154(b) by 453 days.

This patent is subject to a terminal disclaimer.

(21) Appl. No.: 14/068,929

(22) Filed: Oct. 31, 2013

(65) Prior Publication Data

US 2014/0053434 A1 Feb. 27, 2014

Related U.S. Application Data

(62) Division of application No. 13/248,862, filed on Sep. 29, 2011, now Pat. No. 8,595,956.

(51) Int. Cl.

| | |
|---|---|
| ***A43B 13/12*** | (2006.01) |
| ***A43B 7/32*** | (2006.01) |
| ***A43B 13/18*** | (2006.01) |
| ***A43B 13/42*** | (2006.01) |

(52) U.S. Cl.

CPC ..... *A43B 7/32* (2013.01); *A43B 13/12* (2013.01); *A43B 13/122* (2013.01); *A43B 13/125* (2013.01); *A43B 13/181* (2013.01); *A43B 13/186* (2013.01); *A43B 13/187* (2013.01); *A43B 13/42* (2013.01)

(58) Field of Classification Search

CPC ... A43B 13/122; A43B 13/125; A43B 13/181; A43B 13/186; A43B 13/187; A43B 13/42; A43B 3/10; A43B 3/101; A43B 3/102; A43B 3/107; A43B 3/108

See application file for complete search history.

(56) References Cited

U.S. PATENT DOCUMENTS

| | | | |
|---|---|---|---|
| 1,841,942 | A | 1/1932 | Fenton |
| 2,581,524 | A | 1/1952 | Ford |
| 4,364,187 | A | 12/1982 | Melendez |
| 4,638,576 | A | 1/1987 | Parracho et al. |
| 4,642,911 | A | 2/1987 | Talarico, II |

(Continued)

FOREIGN PATENT DOCUMENTS

| | | |
|---|---|---|
| FR | 2772563 A1 | 6/1999 |
| FR | 2802391 A1 | 6/2001 |

OTHER PUBLICATIONS

European Search Report Application No. EP 12 18 3938 Completed: Jun. 13, 2013; Mailing Date: Jul. 1, 2013 5 pages.

*Primary Examiner* — Ted Kavanaugh
(74) *Attorney, Agent, or Firm* — Squire Patton Boggs (US) LLP

(57) ABSTRACT

An article of footwear has a molded outsole which contains a resilient midsole located in the cavity of the outsole and a footbed cover which has a stretch material layer affixed to the outsole and provides a stretch zone. The stretch zone allows the footbed cover to work in conjunction with the resilient midsole to absorb shock upon heel strike or other compression of the midsole to increase comfort. Preferably, the midsole has sections of different hardness in the heel area and the forefoot area.

8 Claims, 7 Drawing Sheets

(56) References Cited

U.S. PATENT DOCUMENTS

| | | | | |
|---|---|---|---|---|
| 4,757,620 | A | 7/1988 | Tiitola | |
| 4,858,340 | A * | 8/1989 | Pasternak | A43B 9/02 36/12 |
| 4,858,341 | A * | 8/1989 | Rosen | A43B 3/26 36/88 |
| 5,592,757 | A | 1/1997 | Jackinsky | |
| 5,899,006 | A | 5/1999 | Donnadieu | |
| 6,418,642 | B1 * | 7/2002 | Bigg | A43B 3/102 12/142 S |
| 6,785,984 | B2 | 9/2004 | Jackinsky | |
| 7,254,906 | B2 | 8/2007 | Morris et al. | |
| 2004/0163280 | A1 | 8/2004 | Morris et al. | |
| 2005/0108898 | A1 * | 5/2005 | Jeppesen | A43B 1/0072 36/30 R |
| 2006/0010717 | A1 * | 1/2006 | Finkelstein | A43B 13/187 36/25 R |
| 2006/0107553 | A1 | 5/2006 | Clark et al. | |
| 2009/0193682 | A1 * | 8/2009 | Rosenbaum | A43B 13/141 36/88 |

* cited by examiner

FOOTWEAR WITH ELASTIC FOOTBED COVER AND SOFT FOAM FOOTBED

FIELD OF THE INVENTION

The present invention relates to footwear. More particularly the present invention relates to the field of comfort footwear having shock absorbing structures.

BACKGROUND

There are many different shoe types, ranging from closed shoes, to slides and clogs, to sandals, and with heel heights ranging from no heel to 4 inches or more. A common issue confronted by a shoe designer is the tradeoffs between cost and comfort and durability and style. For example, a shoe sole that is soft and resilient will typically have poor durability. Accordingly, over the years, different shoe constructions have been developed that provide different degrees of cost and comfort and durability and style. These developments in shoe constructions, along with developments in materials which are lighter and more resilient than traditional materials, have expanded the range of potential footwear constructions over the years and provided consumers with a much greater choice than was available 100 years ago. Nevertheless, the fundamental considerations of low cost, durability, and end-user comfort continue to inspire new developments.

A typical construction for a women's slide or sandal may include a durable molded rubber or plastic outsole shell forming a cavity and a resilient midsole that is molded or glued into the cavity. A footbed liner (which may include an insole pad) is located above the midsole and attached to the outsole and/or midsole. A disadvantage of this typical design is that the designer has a limited ability to design both comfort and durability into the shoe. If the designer selects a very soft, resilient foam for the midsole, it is likely to quickly degrade, making the shoes unusable. If the designer selects a firmer foam for the midsole, the shoe will be less comfortable underfoot.

There is a desire for a footwear construction that overcomes the limitations of the prior art and provides a shoe that has provides a better combination of cost and comfort and durability and style.

SUMMARY OF THE INVENTION

It is accordingly one object of the present invention to provide an article of footwear that overcomes the limitations of the prior art.

It is a further object of the present invention to provide a molded shoe design that is more comfortable underfoot as compared to known shoe designs.

It is yet a further object of the present invention to provide a midsole having a forefoot section and a heel section having different hardness, particularly, wherein the hardness of the forefoot section is less than the hardness of the heel section such that the hardness of each section is selected to absorb impact forces generated by the ball and forefoot sections of the foot and the heel sections of the foot.

It is yet another object of the present invention to provide smooth transition in hardness between the forefoot midsole section and the heel midsole section.

It is yet another object of the present invention to provide a footbed cover that allows the footbed to move with the compression of the midsole, while still providing a durable and comfortable footbed cover.

It is yet another object of the present invention to provide a footbed cover having an elastic stretch zone layer.

These and other objections of the present invention are achieved by an article of footwear having a molded outsole shell having a cavity and a perimeter; a resilient midsole located in the cavity of the outsole shell and having an upper surface; a footbed located at the upper surface of the midsole; and a footbed cover located above the footbed, the footbed cover having a stretch material layer, the stretch material layer being affixed to the perimeter of the outsole shell and having a stretch zone.

In some embodiments of the present invention, the stretch material layer of the footbed cover is coextensive with the footbed cover.

In some embodiments of the present invention, the stretch material layer of the footbed cover extends along substantially the entire perimeter of the footbed cover.

In some embodiments of the present invention the stretch material layer of the footbed cover extends along a portion of the perimeter of the heel area of the footbed.

In further embodiments of the present invention the midsole includes a forefoot section and a heel section having different harnesses. In such embodiments of the hardness of the heel section is preferably greater than the hardness of the forefoot section. Most preferably, a bevel transition, also referred to as a scarf joint, is provided between the forefoot section and the heel section so as to provide a smooth transition between the different hardness sections underfoot.

These and other objects and advantages of the present invention will become more apparent from the following detailed description considered with reference to the accompanying drawings.

BRIEF DESCRIPTION OF THE DRAWINGS

Exemplary embodiments of the invention are explained in more detail in the description which follows and are represented in the drawings, in which.

DETAILED DESCRIPTION

The shoe construction of the present invention is particularly adapted to construction of women's sandals, sledges and clogs. However, it can be used in other applications as well. Generally speaking, the present invention is an article of footwear, comprising: a molded outsole shell having a cavity and a perimeter; a resilient midsole located in the cavity of the outsole shell and having an upper surface, the midsole comprising a forefoot section having a forefoot section hardness and a heel section having a heel section hardness; the heel section hardness being greater than the forefoot section hardness; a footbed located at the upper surface of the midsole; and a footbed cover located above the footbed and having a stretch material layer affixed to the perimeter of the outsole shell.

Figure 1A:
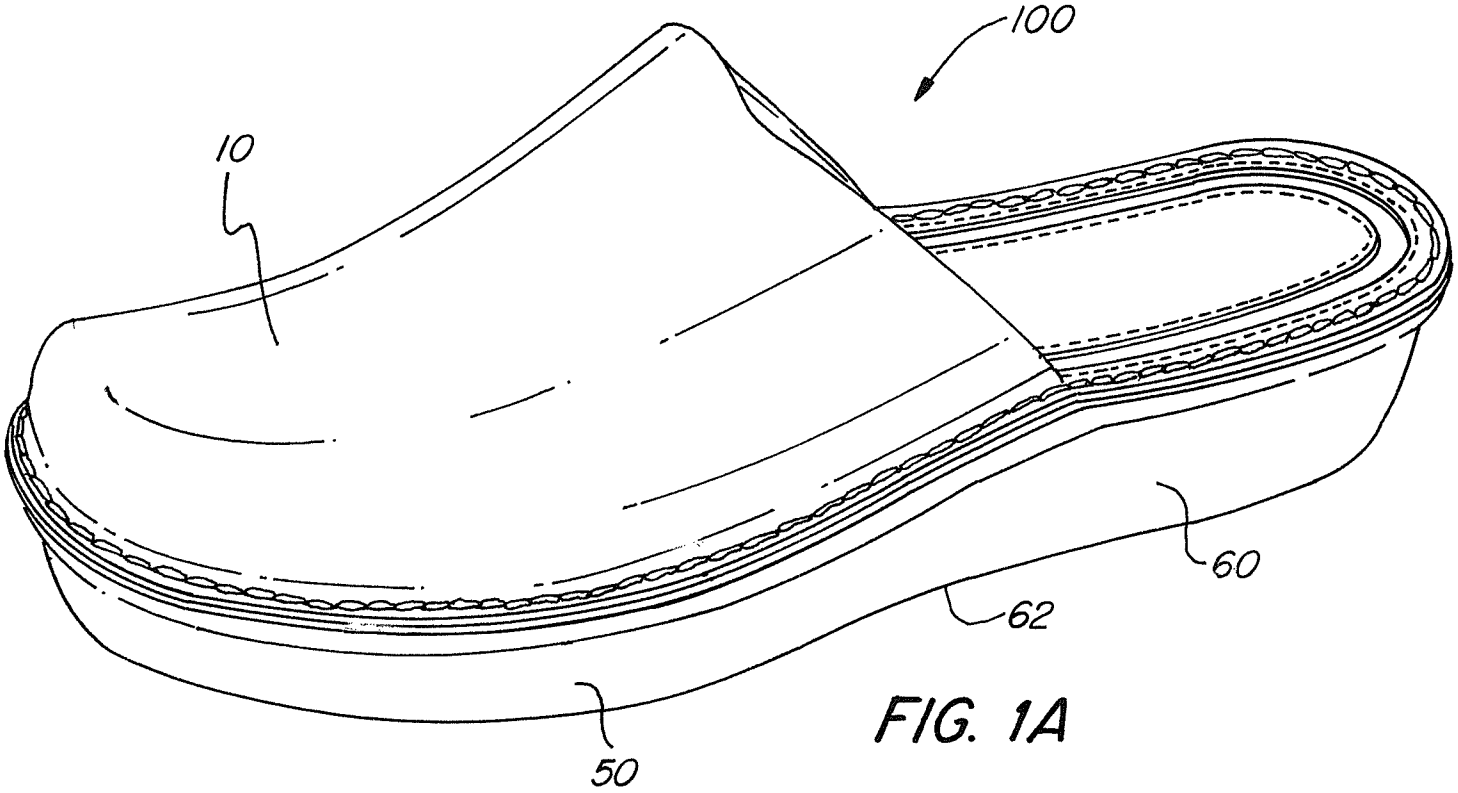
FIG. 1A is a perspective view of shoe according to one embodiment of the present invention.

Referring to FIG. 1A, a shoe 100 according to one embodiment of the present invention is shown. The shoe 100 comprises an upper 10 secured to a sole 50. In the embodiment shown in FIG. 1, the upper 10 is a clog upper, e.g., it extends along the forward section of the shoe 100, but does not extend toward the rear of the shoe 100. It should be understood to a person having ordinary skill in the art that the present invention may be employed in many known shoe designs, and is not limited to the type of shoe illustrated in one or more of the figures of the present application.

Figure 1B:
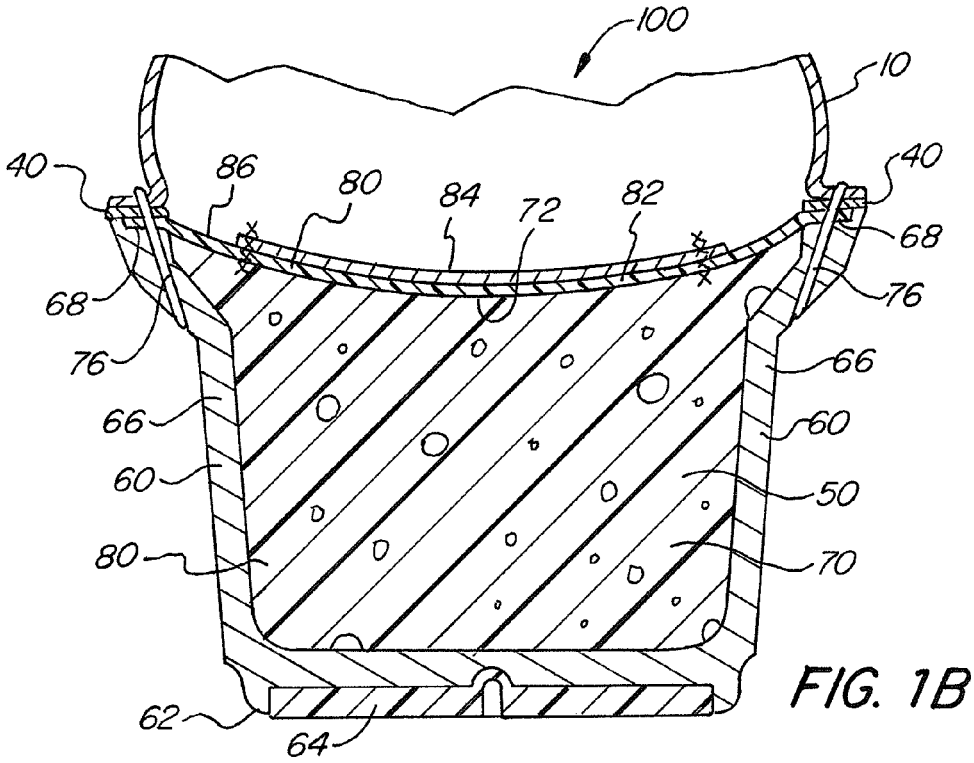
FIG. 1B is a cross-section view of a sole of a shoe according to one embodiment of the present invention.

In reference to FIG. 1B, a cross section view of a shoe 100 according to one embodiment of the present invention is shown. The shoe includes an upper 10 affixed to the sole 50. The sole 50 comprises an outsole shell 60 and a midsole 70. The outsole shell 60 has a bottom 62. The bottom 62 of the outsole shell 62 forms a surface for contacting the ground during locomotion. It should be understood that in some embodiments of the present invention, as shown in FIG. 1A, inserts 64 are molded or inserted into a lower surface of the bottom 62 of the outsole shell 60. In some embodiments the inserts 64 comprise a rubber tread for increasing the traction of the shoe, especially in slippery conditions. It should be understood by a person having ordinary skill in the art that many sole configurations are possible, and the disclosure herein of specific configurations is not intended to limit the present invention.

In further reference to the shoe 100 shown in FIG. 1B, the outsole shell 62 includes a wall 66 that extends upward from the perimeter of the bottom 62 of the outsole shell 60. The walls 66 and the bottom 62 of the outsole shell 60 form a cavity. The top of the wall 68 extends generally perpendicularly to the walking surface.

In further reference to the embodiment shown in FIG. 1B, the outsole shell 60 is molded from thermo plastic rubber, latex rubber, or other materials such as EVA (ethyl vinyl acetate), polyurethane, nitro polyvinyl chloride, or other materials known in the art. In general, it is desired that the outsole have a hardness between 50 and 55 on the Shore A hardness scale.

In further reference to FIG. 1B, the sole 50 further includes a resilient midsole 70. The midsole 70 is adapted to fit inside the cavity formed by the outsole shell 60. The midsole may be molded and then glued into the cavity or formed in place in the outsole shell. The mid sole may comprise one or more different layers. The midsole may comprise one or more hardness zones as described hereafter. A top or upper surface of the midsole forms the footbed 72. The footbed may include the formed midsole 70 or may optionally include an additional insole layer.

In further reference to the embodiment shown in FIG. 1B, the midsole 70 is molded from a soft low density polyurethane foam. In some embodiments of the present invention the outsole shell 60 forms the mold for the midsole 70 and the midsole 70 is molded directly into the outsole shell 60. It is preferred that the polyurethane for the midsole 70 has a relatively low hardness, preferably in the range of 35 to 55 on the Asker C Hardness scale. It should be understood by a person having ordinary skill in the art that many different synthetic materials may be employed having many different densities. The lower hardness is preferred for the midsole 70 so that the midsole will feel comfortable underfoot and will also absorb the shock of heel strike and other impacts associated with walking.

In further reference to FIG. 1B, the shoe further includes a footbed cover 80. The footbed cover 80 is affixed to the perimeter of the outsole shell by stitching or gluing. The footbed cover 80 has a stretch material layer, and it is that stretch material layer which is affixed to the perimeter of the outsole shell. The stretch material layer provides the footbed cover 80 with a "trampoline" functionality, which works in conjunction with the resilient midsole to maximize shock absorption by increasing the effectiveness of the resilient midsole. In particular, the stretch material layer increases the amount of possible compression of the midsole by allowing a greater range of downward travel of the footbed cover as well as providing its own resilient deflection effects. In different embodiments, the entire footbed cover 80 may consist of the stretch material layer (not shown); most preferably, as in FIG. 1B, the stretch material layer is a lower layer and it has a sock liner upper layer secured to an upper surface of the stretch material lower layer with the stretch material extending outwardly from at least a portion of the sock liner layer; alternatively, as in FIG. 1C, the stretch material layer is located around the sock liner layer.

Referring to the embodiment shown in FIG. 1B, the footbed cover 80 comprises a lower stretch material layer 82 and an upper sock liner layer 84. The lower stretch material layer 82 is affixed to the perimeter of the outsole shell. More particularly, in reference to the embodiment shown in FIG. 1B, the lower stretch material layer 82 of the footbed cover 80 is affixed to the perimeter of the outsole shell by stitching 76. In the embodiment shown, the stitching 76 passes through the lower layer 82 and though a portion of the outsole shell 60, specifically, an upper portion of the wall 66 of the outsole shell 62. Otherwise, the footbed cover 80 and a bottom surface of the lower layer 82 are not affixed to the midsole or footbed 72, thereby allowing a portion of the lower layer 82 to move independently of the footbed 72. The lower stretch material is preferably a spandex and/or neoprene materials or combination thereof.

In the embodiment shown in FIG. 1B, the footbed cover 80 further includes upper sock liner layer 84. The upper sock liner layer 84 is secured to an upper surface of the lower layer 82. In some embodiments the upper sock liner layer 84 is secured to the lower layer 82 using an adhesive. In other embodiments the upper sock liner layer 84 is secured to the lower layer 82 using stitching. It should be understood that any known method may be used. In the embodiment shown in FIG. 1B, the upper layer 84 is selected from a material to provide comfort and durability. For example the upper layer 84 may be a treated leather such suede.

In further reference to the embodiment shown in FIG. 1B, an upper 10 is affixed to the sole 50. In some embodiments of the present invention, the upper 10 is affixed to the sole 10 by the stitching 76 that affixes the lower layer 82 of the footbed cover 80 to the perimeter of the outsole shell.

In further reference to the embodiment shown in FIG. 1B, the lower layer 82 extends laterally outward along at least a portion of the upper layer 84. This laterally outward extending portion of the lower layer 82 may be referred to as a stretch zone 86 or flex zone 86. In some embodiments of the present invention, the stretch zone 86 extends between 3 mm to 10 mm, and most preferably approximately 6 mm, outward from a perimeter of the upper layer 84. It should be understood by a person having skill in the art that the outward extension of the stretch zone 86 may vary. In some embodiments of the present invention the lower layer 82 extends outward from the upper layer 84 the footbed 80 along the entire perimeter of the upper layer 84. In some embodiments of the present invention, the length of the outward extension of the stretch zone 86 (i.e. the width of the stretch zone 86) is constant along the entire perimeter of the upper layer 84. In other embodiments of the present invention the width of the stretch zone 86 varies along the perimeter of the upper layer 84.

In reference to the embodiment shown in FIG. 1B, the stretch zone 86 allows the inventive sole design to more efficiently absorb and distribute the downward force created by the user's foot during locomotion. As the force strikes the footbed cover 80, the stretch zone 86 allows the footbed cover to stretch. This in turn allows the midsole to compress and absorb and distribute force. The stretch zone 86 allows the footbed cover 80 to move with the compression of the polyurethane midsole 70.

Figure 1C:
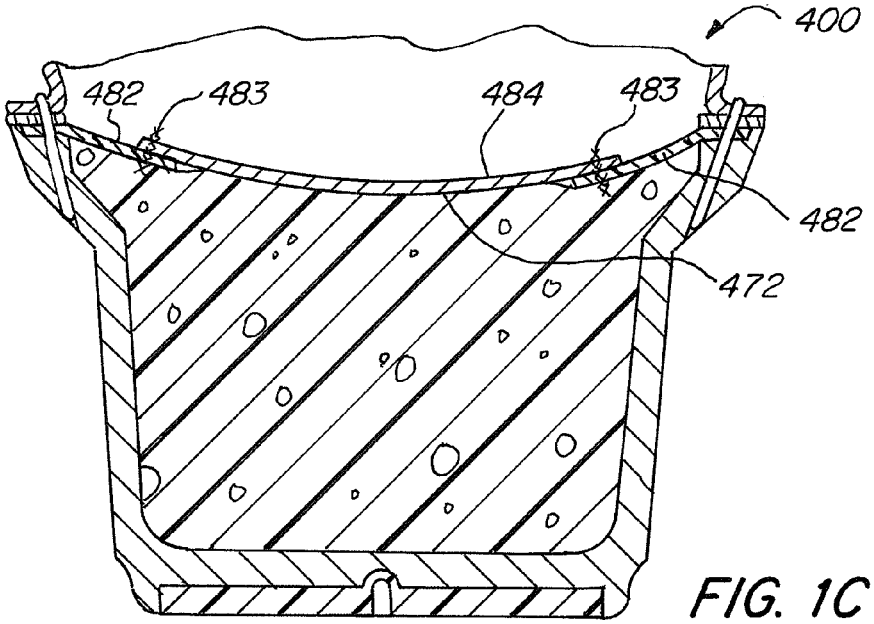
FIG. 1C is a cross-section view of a sole of a shoe according to one embodiment of the present invention.

In reference to FIG. 1C, a shoe 400 in accordance with another embodiment of the present invention is shown. This embodiment is similar to that disclosed in FIG. 1B, however the lower layer 482 does not extend across the area of the footbed 472. In this embodiment, the lower layer 482 is a strip of material that extends along the perimeter of the footbed 472. The upper layer 484 is secured to an upper portion of the lower layer 482 using stitching 483 or some other known means.

Figure 2:
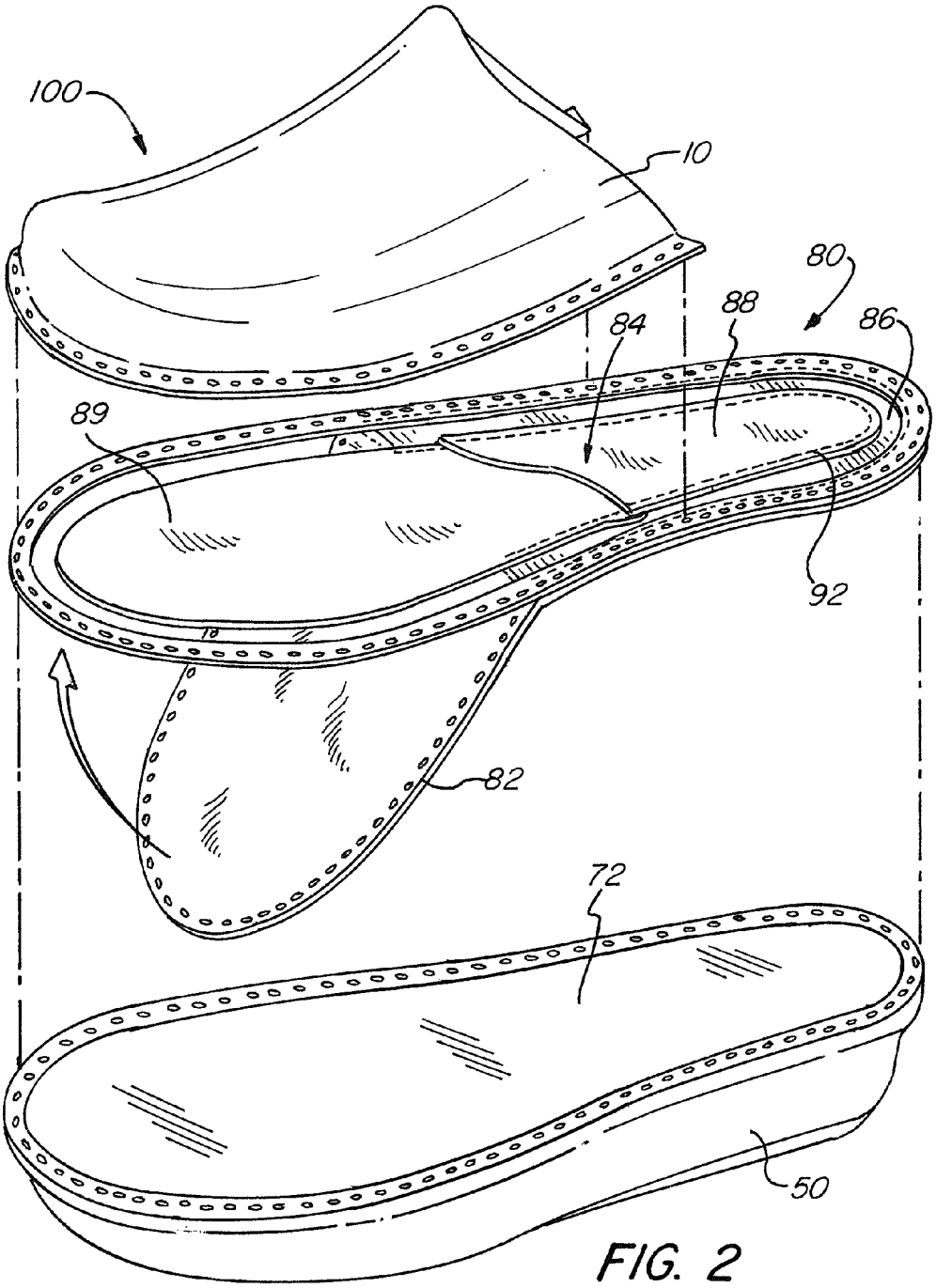
FIG. 2 is an exploded view of the inventive shoe of FIG. 1.

In reference to FIG. 2, a perspective exploded view of a shoe In accordance with one embodiment of the present invention is shown. The shoe 100 includes the sole 50 and the upper 10. The upper surface 72 of the midsole 70 forms the footbed 72. In the embodiment shown in FIG. 2, the footbed cover 80 comprises the lower layer 82 and the upper layer 84 is shown. In the embodiment shown in FIG. 2, the upper layer 84 comprises a first component 88 and a second component 89. The stretch zone 86 extends along the entire perimeter of the upper layer 84. The width of the stretch zone 86 is substantially constant along its entire length. In the embodiment shown in FIG. 2, the upper layer 84 is secured to the lower layer by stitching 92. It should be understood to a person having ordinary skill in the art that any known method for securing the upper layer 84 to the lower layer 82 may be employed including adhesive.

In further reference to the embodiment shown in FIG. 2, a strip 40 of material is provided for facilitating the connection between the different components of the shoe. In reference to FIG. 1B, the strip 40 is shown between the upper 10 and the lower layer 82. The strip 40 is sandwiched between the upper 10 and the footbed cover 80, and more specifically, the lower layer 82 of the footbed cover 80. The stitching 76 affixes the upper 10, the strip 40, the footbed cover 80, and the outsole shell 60. In open heel shoe designs, the strip 40 serves as a decorative component. In some designs, the strip 40 serves to conceal structural features of the design. In some embodiments of the present invention a welt/corner stitch is employed to secure the different components together. In some embodiments of the present invention the perimeter of the lower layer 82 of the footbed cover 80 is secured to the sole 50 by a corner stitch. In some embodiments, additional binding is added around at least a portion of the perimeter of the footbed to prevent the lower layer from pulling out of the corner stitch. In yet further embodiments, this connection is further secured using topline tape. It should be understood to a person of ordinary skill in the art that many different methods and configurations are known and may be employed for securing the different components of the inventive article of footwear.

Figure 3:
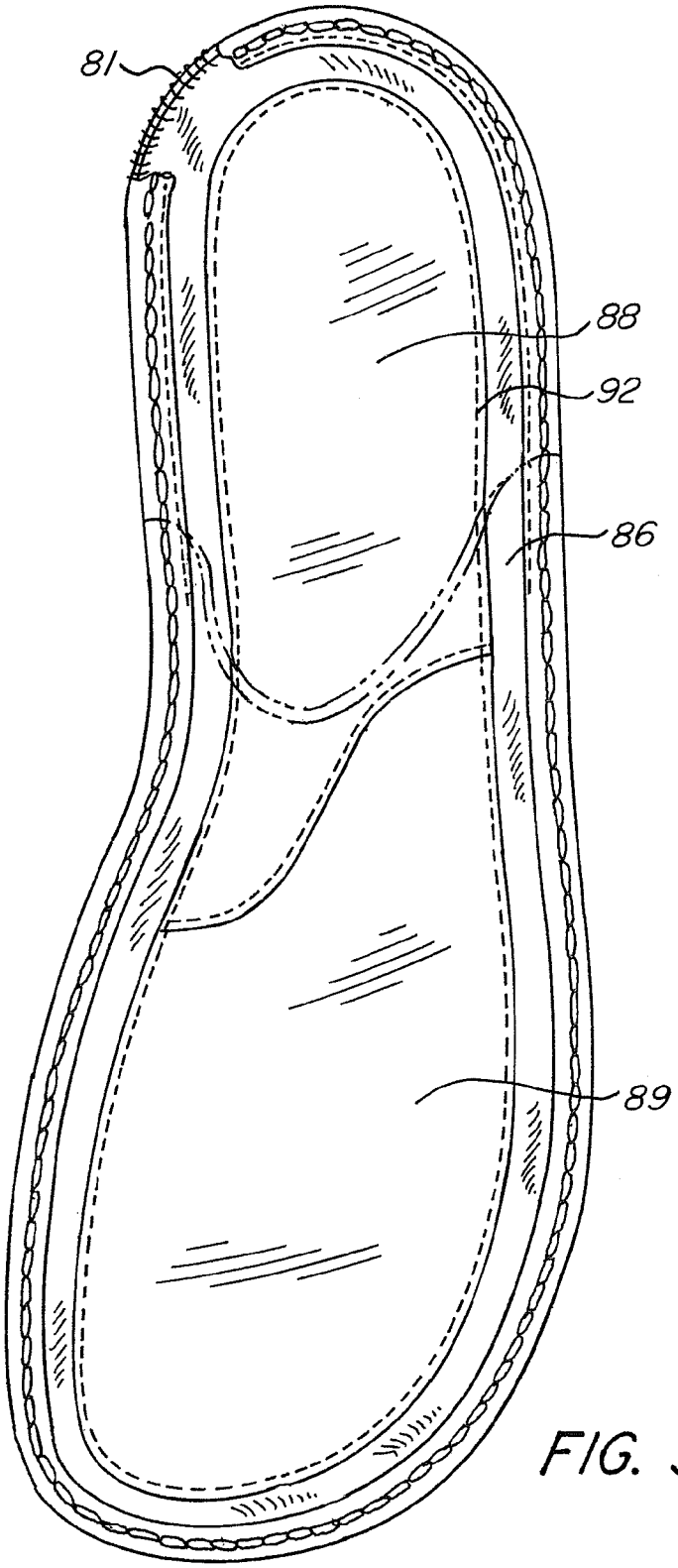
FIG. 3 is a top view of a shoe according to one embodiment of the present invention.

In reference to the FIG. 3, a top view of one embodiment of the present invention is shown. In this embodiment, the stretch zone 86 extends along the entire perimeter of the upper layer 84 of the footbed cover 80. In the heel section of the shoe as shown in FIG. 3 a portion of the securing strip 40 is cut-away. The cut-away section reveals the binding 81 that is added to prevent the lower layer 82 from pulling out of the corner stitching (not shown in cut-away section).

Figure 4:
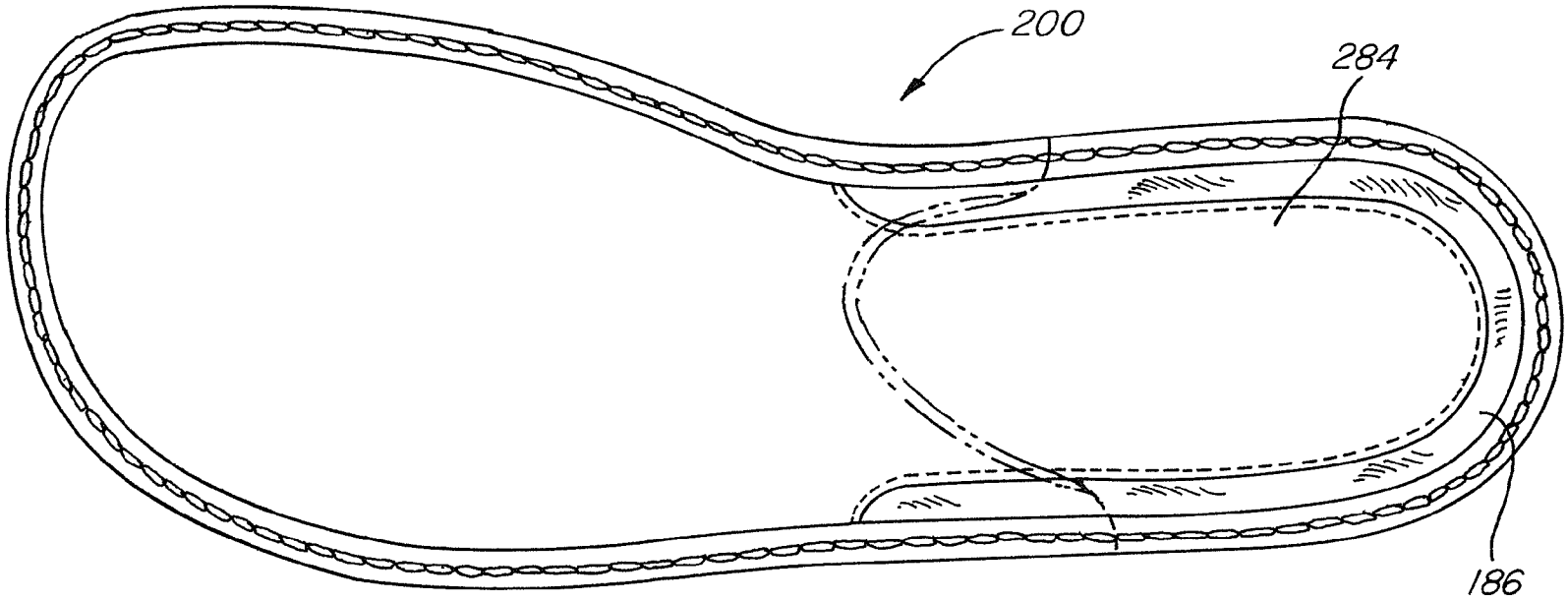
FIG. 4 is a top view of a shoe according to one embodiment of the present invention.

In reference to FIG. 4 a top view of a shoe 200 in accordance with one embodiment of the present invention is shown. In this embodiment the stretch zone 186 extends along a portion of the perimeter of the upper layer. In this embodiment, the stretch zone 186 extends along a portion of the perimeter of the second section proximate to the heel. It should be understood that the length that the stretch zone 186 extends along the perimeter of the upper layer 284 may vary. The description of one or more embodiments of a stretch zone 186 extending a certain length is not intended to limit the present invention.

Figure 5:
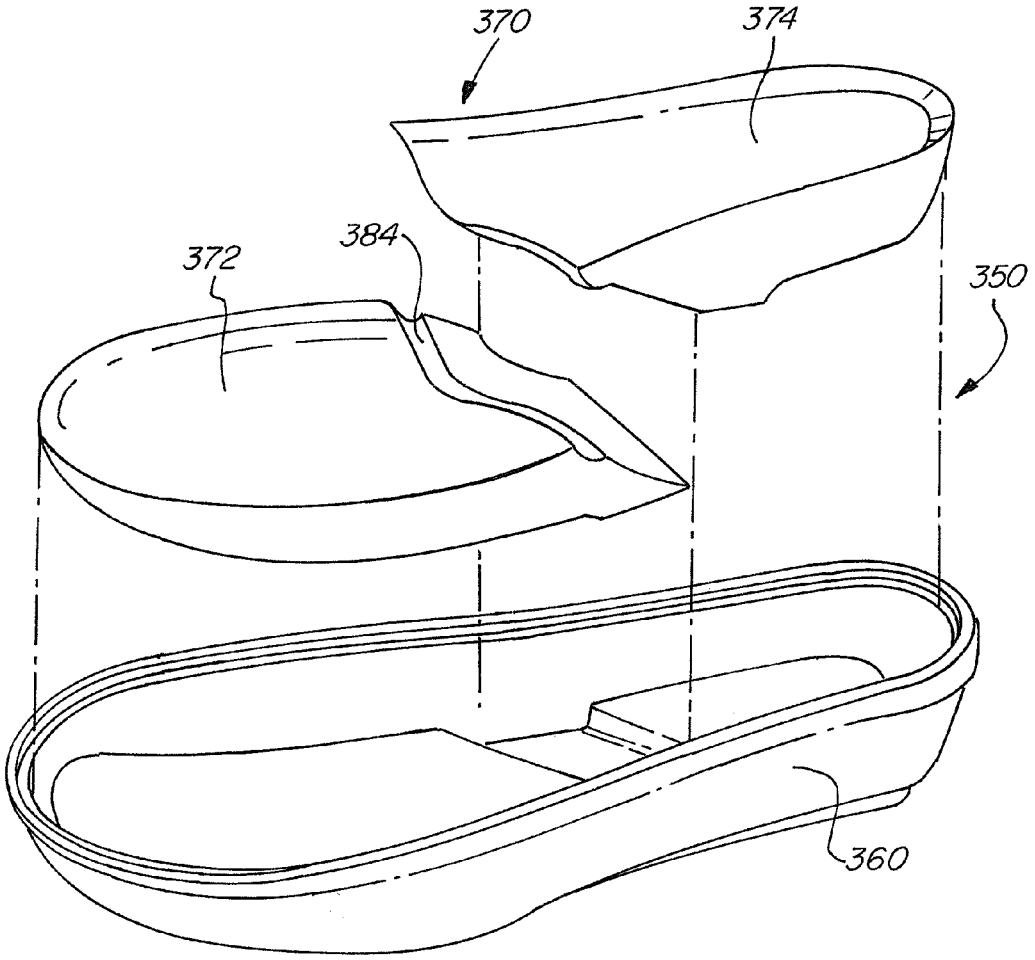
FIG. 5 is an exploded perspective view of a sole of a shoe according to one embodiment of the present invention.

In FIG. 5 an exploded perspective view of a sole 350 of a shoe in accordance with one embodiment of the present invention is shown. In reference to FIG. 6 a cross-section view of a sole 350 of shoe 300 of FIG. 5 is shown. The sole 350 comprises an outsole shell 360 and a midsole 370. The midsole 370 comprises a forefoot section 372 and a heel section 374. The midsole section 372, 374 are made from polyurethane. In some embodiments the forefoot section 372 is made from a lower hardness polyurethane as compared to the heel section 374 which is formed from a higher hardness polyurethane. For example, the forefoot section 372 may be formed from polyurethane having a hardness of 35-40 on the Asker C scale, while the heel section 374 may be formed from a polyurethane having a hardness of 45-50 on the Asker C scale. It should be understood that many different materials and densities thereof are well within the scope of a person of ordinary skill in the art. For example, in some embodiments of the present invention the forefoot section 372 may have a hardness of 35-40 on the Asker C scale, while the heel section 374 may be formed from a polyurethane having a hardness of 50-55 on the Asker C scale.

The sole 350 having a forefoot section 372 and a heel section 374 provides a more comfortable walking surface because it is customized based on the location of different magnitude forces during locomotion. For example, the heel strike is typically more forceful as compared to a strike by the forefoot section of the foot. By providing a denser heel section 374 of the midsole 370 as compared to the forefoot section 372, the sole 350 is able to provide a firm and sturdy walking surface, while retaining some element of comfort.

Figure 6:
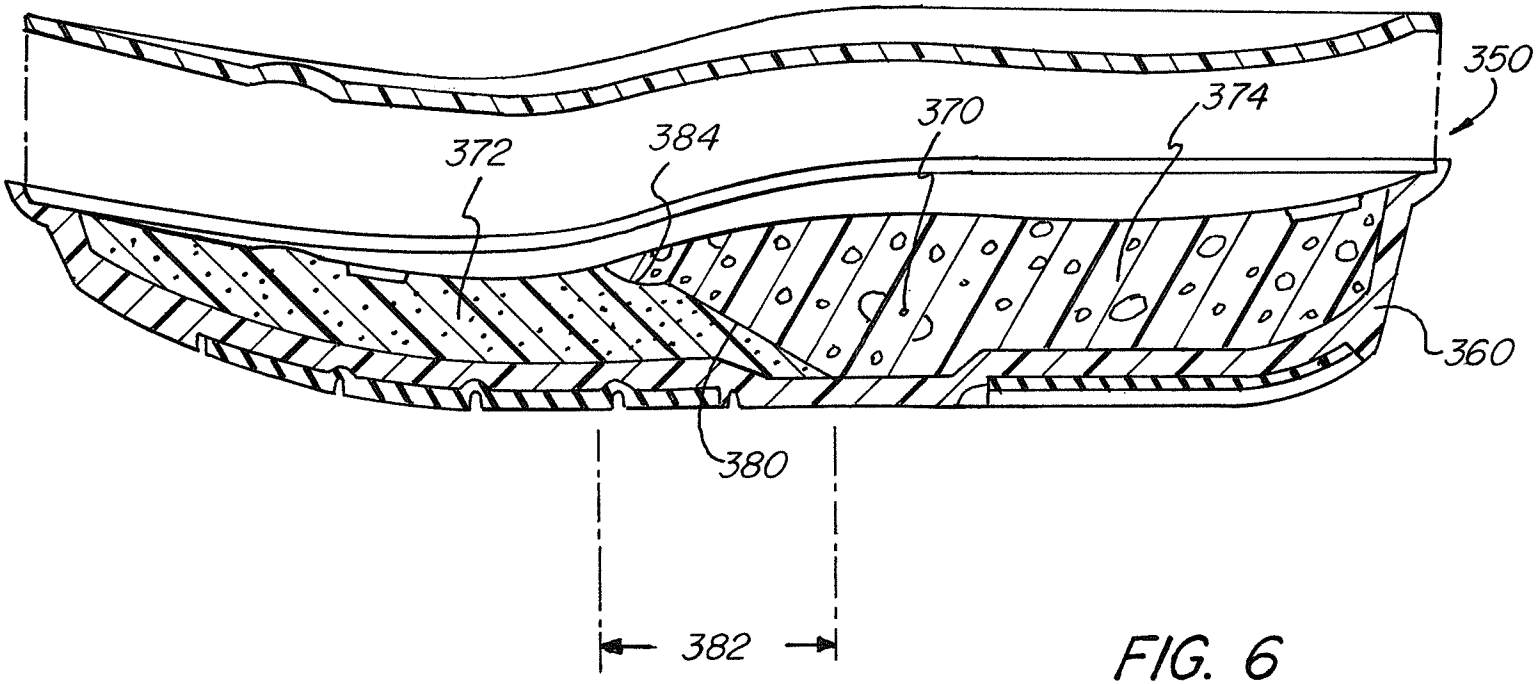
FIG. 6 is an exploded cross-section view of a sole of a shoe according to one embodiment of the present invention.

In reference to FIGS. 5 and 6, the midsole includes a scarf joint 380 between the forefoot section 372 of the midsole 370 and the heel section 374 of the midsole 370. The scarf joint 380 provides the sensation of a smooth footbed surface by blending the transition from the higher hardness heel section 374 and the lower hardness forefoot section 372. In reference to the embodiment shown in FIGS. 5 and 6, the scarf joint is located in the approximate center of the length of the midsole 370 and extends across the width of the midsole 370.

The area of the scarf joint is referred to as the transition zone 382. The length of the transition zone 382 as measured from a heel side of the midsole to the forefoot side of the midsole is approximately 43 mm. In the embodiment shown in FIGS. 5 and 6, the gradient of the scarf joint between the forefoot section 372 and the heel section 374 is approximately 30 degrees in relationship to the ground. This gradient provides for a smooth transition between the forefoot section 372 and the heel section 374. In addition, this gradient helps to prevent the forefoot section 372 from shifting in relation to the heel section 374. In addition, the scarf joint may include a flex lip 384 to further help prevent the forefoot section 372 from shifting in relation to the heel section 374.

The combination of elements described above provides a footwear construction that is an improvement over existing constructions. The combination of midsole sections of different hardness provides both greater comfort and better durability than a midsole using a single foam. The stretch material layer/stretch zone in the footbed cover provides a resilient support that works in conjunction with the midsole to provide enhanced comfort and support. At the same time, it also extends the usable life of the shoe by allowing continued use of the shoe even if the midsole foam layer has become compressed over time.

Although the invention has been described with reference to embodiments herein, those embodiments do not limit the scope of the invention. Modification to those embodiments or different embodiments may fall within the scope of the invention.

What is claimed is:

1. An article of footwear, comprising:

a molded outsole shell having a cavity and a perimeter;

a resilient midsole located in and entirely filling the cavity of the outsole shell and having an upper surface, the midsole comprising a forefoot section having a forefoot section hardness and a heel section having a heel section hardness; the heel section hardness being greater than the forefoot section hardness;

a cover located on the midsole upper surface, the cover having a lower stretch material layer, the stretch material layer being affixed to the perimeter of the outsole shell, and a sock liner upper layer secured to an upper surface of the stretch material lower layer;

whereby downward force on the cover causes resilient deflection of the cover in conjunction with compression of the midsole.

2. The article of footwear of claim 1, wherein the stretch material layer is located along a portion of the perimeter of the cover proximate to a heel area.

3. The article of footwear of claim 1, wherein the stretch material layer is located along substantially the entire perimeter of the cover.

4. The article of footwear of claim 1, wherein the sock liner upper layer has a lesser area than the stretch material lower layer, such that the lower layer extends laterally outwardly from the upper layer along a least a portion of a perimeter of the upper layer.

5. The article of footwear of claim 1, wherein the stretch material layer comprises one or more of neoprene and spandex materials.

6. The article of footwear of claim 1, wherein the forefoot section and the heel sections are connected by a scarf joint.

7. The article of footwear of claim 6, wherein the scarf joint forms a 150. degree. angle.

8. The article of footwear of claim 6, wherein the scarf joint includes a flex lip provided on the heel section.

* * * * *